United States Patent [19]

Kashiwagi et al.

[11] 4,395,485

[45] Jul. 26, 1983

[54] DRY ELECTROPHOTOGRAPHIC TONER COMPRISING SMALL, POLYMER COATED PARTICLES AS FLOW AGENT

[75] Inventors: Michio Kashiwagi; Kiichi Nakajima, both of Otsu, Japan

[73] Assignee: Toray Industries, Inc., Tokyo, Japan

[21] Appl. No.: 321,178

[22] PCT Filed: Apr. 2, 1981

[86] PCT No.: PCT/JP81/00073

§ 371 Date: Nov. 9, 1981

§ 102(e) Date: Nov. 9, 1981

[87] PCT Pub. No.: WO81/02935

PCT Pub. Date: Oct. 15, 1981

[30] Foreign Application Priority Data

Apr. 3, 1980 [JP] Japan ..... 55-43860

[51] Int. Cl.[3] ..... G03G 9/08; G03G 13/09

[52] U.S. Cl. ..... 430/903; 430/110; 430/106.6; 428/405; 428/407; 427/219; 427/221; 252/11; 106/308 M; 106/300

[58] Field of Search ..... 430/109, 110; 427/219, 427/221; 428/405, 407; 106/308 M, 300; 252/11

[56] References Cited

U.S. PATENT DOCUMENTS

| | | | |
|---|---|---|---|
| 3,185,777 | 5/1965 | Rheinfrank | 430/107 X |
| 3,224,993 | 12/1965 | Wynne | 106/300 X |
| 3,236,639 | 2/1966 | Tomanek et al. | 430/107 X |
| 3,349,703 | 10/1967 | Varron | 101/426 |
| 3,781,207 | 12/1973 | Tamm | 430/110 X |
| 3,811,880 | 5/1974 | Browning . | |
| 3,944,705 | 3/1976 | Fujioka | 428/405 X |
| 4,073,980 | 2/1978 | Westdale et al. | 428/404 |
| 4,248,950 | 2/1981 | Westdale | 430/110 X |

FOREIGN PATENT DOCUMENTS

| | | | |
|---|---|---|---|
| 2720436 | 12/1976 | Fed. Rep. of Germany | 430/110 |
| 53-87734 | 8/1978 | Japan . | |

OTHER PUBLICATIONS

Int. Appl. PCT/JP81/00073, Toray Industries, p. 2286, (1981).

*Primary Examiner*—John D. Welsh
*Attorney, Agent, or Firm*—Barnes & Thornburg

[57] ABSTRACT

This is one-component type dry developer for an electrophotography which is improved on humidification ability, and consists of mixture of toner with a particle size of 5~50 (μ) and hydrophobic flow agent. The flow agent is made by covering inorganic, organic, metallic or alloy powder with thin film of non-hydrophilic synthetic resin. By using electric conductive material as core and making a range of resin film thickness so as to cause tunnel effect of electron or ion, the flow agent which has non-hydrophilic property and electric conductive property is obtained.

18 Claims, No Drawings

DRY ELECTROPHOTOGRAPHIC TONER COMPRISING SMALL, POLYMER COATED PARTICLES AS FLOW AGENT

TECHNICAL FIELD TO WHICH THE INVENTION BELONGS

The present invention relates to dry toner, particularly to one-component type dry toner used as developer in a copying apparatus or a printer according to an electrophotographic process.

BACKGROUND ARTS OF THE INVENTION

An electrophotographic process is well utilized in a copying apparatus or a printer. In the process, for example, an electrostatic latent image is formed first on a photosensitive medium such as a photosensitive drum and then the electrostatic latent image is visualized by the development with a toner. The visualized image, namely a toner image, can be converted to a copied or printed information by fixing the toner image directly onto the photosensitive medium. However, for the repeated use of the photosensitive medium, it is necessary to transfer the toner image to other transfer medium such as paper. Therefore, the process usually includes a transfer process of the toner image. The transfer utilizes so-called Coulomb force by which polar charge reverse to the toner image, which was given to the transfer medium by corona discharge, pulls the toner of the toner image toward the transfer medium. The toner pulled on the transfer medium is then fixed there by heat or pressure, or both.

Dry toner is a developer used in the above-mentioned development process. It is classified into one-component type and two-component type. The one-component type toner consists of a mixture of resin powder as main part and flow agent which gives a flowability to the resin powder. On the other hand, two-component type toner consists of a mixture of resin powder as main part and magnetizable powder, namely carrier.

The toner development by one-component type toner is carried out by utilizing its own electrostatic induction ability. That is, since the one-component type toner has some electric conductivity, the contrary polar charge to the electrostatic latent image is induced by electrostatic induction when it is brought near the electrostatic latent image. Accordingly, Coulomb force acts between the electrostatic latent image and the toner and the toner is pulled toward the electrostatic latent image.

Thus, in the development process, the one-component type toner must be conductive. Contrariwise, since the transfer utilizes corona discharge as mentioned above, the toner must also be insulative. Namely, the one-component type toner should have a delicate balance of properties: electric conductivity and insulation ability which conflict with each other. In order to always obtain an image of constant density, it is necessary that the balance is stable. However, the property of electric conductivity or insulation ability is nothing else but the problem of the degree of resistivity of the toner. Since the value depends on not only its composition but also largely on the environmental condition, especially humidity of air, it is essentially unstable.

In conventional one-component type toner, silica is used, for example, as flow agent. Since silica particles are very fine and have a large specific surface area in order to increase flowability of the toner, they very readily absorb water. Therefore, it is very difficult to maintain the resistivity of the toner constant and a decrease in flowability of the toner due to absorbed humidity also occurs.

On the other hand, another one-component type toner is known, wherein hydrophobic silica is used as flow agent. All active sites of this type of silica, where water is absorbed, namely hydroxyl (OH) radical at the surface, are chemically blocked with dimethyldichlorosilane, etc. Consequently, the hydrophobic silica has little tendency to absorb water and thus the resistivity of the toner is kept almost constant irrespective of the level of humidity in air. However, since, in this toner, there are no polar OH radicals at the surface of hydrophobic silica flow agent, the flow agent has become neutral and can have no definite polar charge. The resin powder alone gives insufficient polarity to the toner and an admixture with charge control agent is recommended. Then, the charge control agent itself will be humidified, making it difficult again to maintain constant resistivity of the toner and decreasing the flowability of the toner.

In contrast with such one-component type, in the two-component type toner which will be explained hereinbelow, the only requirement is insulation ability. Namely, toner development with the two-component type toner is carried out by pulling the toner to the electrostatic latent image with an electrostatic force generated through frictional charge between resin powder and carrier. Thus, the transfer process utilizes the insulation ability of the toner and there is no need for delicate control, as is necessary with one-component type toner. However, in the two-component type toner, resin powder is consumed while carrier remains unused for repeated use. So it is necessary to make up the former to keep the concentration of the same and the carrier itself also becomes ineffective through repetitious use. With the one-component type toner, such troublesome maintenance as concentration adjustment and replacement of carrier is totally unnecessary.

DISCLOSURE OF THE INVENTION

The object of the present invention is to provide one-component type dry toner of stable resistivity against humidification.

Another object of the present invention is to provide one-component type dry toner which does not decrease in flowability by humidification.

Still another object of the present invention is to provide one-component type dry toner that can keep a high level of polarity for a prolonged period.

In order to achieve the above objects in accordance with the present invention, a dry toner is proposed comprising resin powder with a particle size of 5~50 ($\mu$) and flow agent which consists of inorganic, organic, metallic or alloy powder covered with thin film of non-hydrophilic polymeric material. The dry toner of the present invention is stable in resistivity and does not decrease in flowability. It also can keep a high level of polarity.

THE BEST MODE FOR CARRYING OUT THE INVENTION

The one-component type toner of the present invention will be explained in detail hereinbelow.

The one-component type toner of the present invention consists of a mixture of resin powder as main part and flow agent that improves flowability of the toner by giving flowability to the resin powder. The flow agent consists of socalled cores made of inorganic, organic, metallic or alloy powder covered with thin film of non-hydrophilic synthetic resin.

The resin powder serves to form copy information or print information onto electrostatic latent image forming medium or transfer medium. Therefore, the resin powder, in the fixing process of the above-mentioned electrophotographic process, must be fixed easily and strongly onto the electrostatic latent image forming medium or transfer medium by heat or pressure, or both. Preferred example of the material suitable for such resin powder of the present invention are natural resins, natural resins modified by synthetic resin (modified natural resins), synthetic resins, natural rubbers and synthetic rubbers, which will be more specifically explained below:

Natural resins: balsam, rosin, shellac, copal, etc;

Modified natural resins: the natural resins modified by synthetic resin such as vinyl resin, acrylic resin, alkyd resin, phenolic resin and oleo resin;

Synthetic resins: vinyl resin, acrylic resin, polyolefin resin, polyamide resin, polyester resin, alkyd resin, phenol-formaldehyde resin, keton resin, coumarone-indene resin, amino resin, epoxy resin, etc;

Natural rubbers: poly(cis-1,4-isoprene), as essential component;

Synthetic rubbers: chlorinated rubber, cyclized rubber, isobutylene rubber, ethylene-propylene rubber, ethylene-propylene-diene rubber, butadiene rubber, butyl rubber, styrene-butadiene rubber, acrylonitril-butadiene rubber, etc.

The above-mentioned synthetic resins are explained still further:

Vinyl resins: vinyl chloride resin, vinylidene chloride resin, vinyl acetate resin, polyacetal resin (polyvinyl butyral resin, for example), vinyl ether resin, etc;

Acrylic resins: polyacrylate, polymethacrylate, copolymer of acrylate, copolymer of methacrylate, etc;

Olefin resins: polyethylene resin, polypropylene resin, polystyrene resin, copolymer of styrene, etc;

Polyamide resins: nylon-12, nylon-6, nylon-66, polyamide modified by polyaliphatic acid, etc;

Polyester resins: polyethylene terephthalate, polyethylene isophthalate, copolymer of ethylene terephthalate and ethylene isophthalate, polytetramethylene terephthalate, polytetramethylene isophthalate, copolymer of tetramethylene terephthalate and tetramethylene isophthalate, etc;

Alkyd resins: phthalic acid resin, maleic acid resin, etc;

Amino resins: urea-formaldehyde resin, melamine-formaldehyde resin, etc.

Further, in the present invention, the resin powder may be a mixture of two or more of the materials hereinabove mentioned. It is also possible, in order to carry out the fixing easily and strongly, to mix such material having a low melting point as: aliphatic wax, metallic salt of acid and low molecular-weight synthetic resin.

Further, the resin powder may contain black or other coloring agent for the purpose of coloring the copy information or print information onto the electrostatic latent image forming medium or transfer medium. As such coloring agent, pigments such as carbon black, acetylene black or lamp black as well as dyestuffs such as basic dye, acid dye, disperse dye or direct dye are preferred.

In the development process of the electrophotographic process, toner is transferred usually by a magnetized roll. Magnetic powder may be contained in the above-mentioned resin powder to give the toner magnetism. Magnetic powders suitable for such purpose, for example, are powdered metals such as manganese, iron, cobalt, nickel or chromium, metal oxides such as chromium dioxide, iron sesquioxide or triiron teroxide, ferrites represented by $MFe_2O_4$ wherein M stands for Mn, Co, Ni, Mg, Zn or Cd, or powdered alloys containing manganese, copper and tin.

When the resin powder is too small in size, background contamination occurs, while the resolution decreases with too large size. Therefore, in the present invention, the size of the resin powder, namely the particle size, is limited within a range of $5\sim50$ ($\mu$). Namely, the particle size of the resin powder must be no smaller than $5\mu$. Otherwise, the resin powder would be captured by the electrostatic latent image forming medium or the transfer medium like paper structure and the background would be contaminated. For a resolution of 5 lines per 1 mm or better, the particle size of the resin powder must be no greater than $50\mu$. The preferred average particle size of the resin powder ranges about $8\sim15$ ($\mu$).

The flow agent on the surface of the resin powder or between the resin powders gives flowability to the toner. It is consumed with the resin powder. The flow agent of the present invention consists of cores consisting of inorganic, organic, metallic or alloy powder, covered with thin film of non-hydrophilic synthetic resin. With the aid of this thin film, the flow agent is now almost completely hydrophobic. Materials suitable for the cores of the flow agent will be explained below in detail:

Inorganic compounds: oxide, sulfide, nitride, carbon black, etc;

Organic compounds: metallic soap, higher fatty acid, fatty acid amide, higher alcohol, higher alcohol ester, etc;

Metals: iron, copper, tin, nickel, cobalt, zinc, silver, etc;

Alloys: alloy containing at least one of the above metals as main component.

Further, in the present invention, the following oxides, sulfides or nitrides may be used:

Oxides: silica, alumina, magnesia, titania, calcia, zirconia, etc;

Sulfides: molibdenum disulfide, tungsten disulfide, etc;

Nitrides: boron nitride, silicon nitride, aluminum nitride, etc.

The above-mentioned cores may contain charge control agent to give the toner an adequate level of polarity. For example, electron donative dyestuff of nigrosine can be used for positively charged toner. For negatively charged toner, such electron-acceptive organic complexes may be employed as monoazo dye metallic complex and metallic salt obtained from ethendiol.

The thin film of non-hydrophilic synthetic resin covering the cores may be such resins as epoxy resin, polyester resin, polystyrene resin, polyvinyl chloride resin, polyolefin resin, acrylic resin, xylene resin and silicone resin. They may be either thermosetting or thermoplastic. These synthetic resin must be non-hydrophilic, with few active sites within its molecule to absorb water.

Thickness of the thin film is preferably no greater than 1000 Å, more preferably no greater than 200 Å. Thus, the film is very thin. The reason why such thin film is preferred is that it can make the flow agent hydrophobic without much altering the core's properties. The most important one of such properties is electric conductivity. For example, carbon black itself is electrically conductive, but it decreases in the electrical conductivity when covered with thin film. Therefore, the thickness of the thin film should be limited as above in order to make the flow agent hydrophobic when the electric conductivity of the flow agent must be retained. This retainment of the covered agent is due to "tunnel effect" of electron or ion.

The above-mentioned thin film can be formed, for example, by absorbing the non-hydrophilic synthetic resinous material together with a chain extender or a hardener onto the surface of the cores, followed by heat curing. Alternatively, it can be formed by absorbing the non-hydrophilic synthetic resin or by contacting solution of the resin to the surface of the cores before drying.

As explained above, the flow agent on the surface of the resin powder or between resin powders makes the resin powder movable and gives the flowability to the toner. The larger the specific surface area of the flow agent is, the more effective it is. Therefore, the flow agent consists of very fine particles and its particle size even when covered with thin film is preferably no greater than 1μ, more preferably no greater than 0.5μ.

The preferred amount of the flow agent based on the total toner is no greater than 20% in weight, more prefarably no greater than 5%. Since the flow agent is a kind of lubricant, a small amount is enough, so long as it is effective in this respect. However, a content no less than 0.01% is prefarable.

The larger the density of the flow agent is, the more effective it is in giving the flowability, as it readily moves due to gravity. The prefarable density of the flow agent is no less than 1.5, more prefarably no less than 2.0. The aggromerated flow agent, even when its density is more than 1, often floats on water due to thin covering film of non-hydrophilic synthetic resin. The hydrophobic flow agent and occluded air thereamong have an apparent density low enough for such phenomenon. However, the flow agent floating on water in the aggregated state starts to sink down, when a surface-active agent is added: water creeps among the flow agent As detailed above, the dry toner of the present invention is one-component type dry toner comprising the flow agent which consists of cores of inorganic, organic, metallic or alloy powder covered with thin film of non-hydrophilic synthetic resin. Consequently, the dry toner of the present invention shows high hydrophobic property and thus the temperature dependance of resistivity, which is the defect of the conventional one-component type toner, is much improved. Depending on combination of the resin powder and flow agent, the resistivity of the dry toner of the present invention is stable at $10^{11} \sim 10^{14}$ (Ω·cm), suitable for one-component type toner. The decrease in flowability with humidification is almost none.

Moreover, unlike the conventional one-component type dry toner, wherein hydrophobic silica is used as the flow agent, from which all polar radicals are chemically blocked, the dry toner of the present invention is capable to be strongly charged. When a charge control agent exists at the core of the flow agent, namely inside the thin film, this property can be strengthened without detriment to the hydrophobic ability.

As mentioned above, by using the dry toner of the present invention, it is able to always maintain the density of copy information or print information formed on the electrostatic latent image forming medium or transfer medium at a proper level.

EXAMPLE 1

The dry toner of the present invention comprising resin powder consisting of polyvinyl butyral resin and flow agent consisting of titanium oxide covered with thin film of silicone resin was prepared as follows.

Resin powder: Polyvinyl butyral resin "Eslex" BM-2, manufactured by Sekisui Chemical Co. Ltd., specifically pure caster wax (aliphatic wax having a low melting point), manufactured by Hayashi Junyaku Kogyo Co. Ltd., and triiron teroxide EPT-1000, manufactured by Toda Kogyo Co. Ltd., were mixed by the ratio of 6 weight %, 24 weight % and 70 weight %, respectively.

Next, the above mixture was melted and stirred by a mixer for one hour under a temperature of 150° C. and then, it was cooled to a room temperature and solid mixture obtained.

Next, the solid mixture was hammer-milled into powder having a particle size of no greater than 100μ. Further, the powder was jet-milled into fine powder having a particle size of no greater than 30μ.

Next, the fine powder was sprayed into air current heated at a temperature of 250° C., in order to reform it spherical and further, only fine powder having a particle size of 8~25 (μ) was taken out by using an air classifier.

Flow agent: A vessel with 10 g of titanium oxide P-25 (0.03μ in particle size and 50 $m^2/g$ in specific surface area by BET method), manufactured by Nippon Aerosil Co. Ltd., was put in a desiccator and titanium oxide was vacuum-dried. Next, air was introduced into the above desiccator through a vessel with silica gel and a vessel with xylene dehydrated by calcium chloride and then, inside of the desiccator was returned at a normal atmosphere. By this treatment, xylene was absorbed on the surface of titanium oxide.

Next, 14 mg of hexamethylene diisocianate (99.9% in purity), manufactured by Tokyo Kasei Co. Ltd., was added to 100 c.c. of xylene, dehydrated by calcium chloride. The mixture was well mixed. Further, the above xylene-absorbed titanium oxide was added to the mixture and a dispersed first solution was obtained by stirring the mixture for 10 minutes under a room temperature.

On the other hand, 237 mg of silicone ES1001 (silicone paint modified by epoxy), manufactured by Shinetsu Silicone Co. Ltd., was dissolved in 30 g of isobutyl acetate to form a second solution.

Next, the dispersed first solution and the second solution were mixed and stirred for 10 minutes and then, 100 g of aliphatic hydrocarbon "Isoper H", manufactured by Esso Chemical Co. Ltd., was added to this as solvent. The mixture was stirred for 5 minutes. Then, the mixture was heated at 120~125 (°C.) with agitation on an oil bath for 90 minutes.

Next, the vessel was taken out from the oil bath and was left still. Precipitate was obtained through decantation.

Next, 100 c.c. of isopropyl alcohol was added to the precipitate. After stirring for 5 minutes, it was passed through an aspirated filter and the filtrate was washed twice with isopropyl alcohol.

Next, the washed filtrate was taken out from the filter, transferred to a beaker, dried for 30 minutes at a temperature of 80° C. and further dried for 30 minutes at a temperature of 150° C. Hexamethylene diisocianate reacts as hardener and the silicone absorbed on the surface of titanium oxide was hardened. Thus, titanium oxide was covered with thin film of silicone resin.

Thickness of the thin film of the flow agent thus obtained must be about 33 Å, if all silicone was effectively filmed on each spherical titanium oxide having a partical size of 0.03μ, when a uniform thickness was assumed. With such covering film, the flow agent becomes hydrophobic and all of flow agent floated on the water surface even if they are dipped in water and stirred. This is surprising because the density of titanium oxide forming core is as high as about 4.

Toner: One-component type dry toner of the present invention was prepared by adding the above flow agent to the above resin powder so as to be 0.4 weight % based on the total weight and by mixing them for 30 minutes under dry condition, this toner had positive polarity.

Comparative toner: On the other hand, for comparison, one-component type dry toner in which contains 0.4 weight % of hydrophobic silica explained in this specification as flow agent instead of the above flow agent was prepared. This toner had non-polarity.

Next, copy test was carried out with an electrophotographic copying apparatus EP-310, manufactured by MINOLTA CAMERA CO. LTD., employing the toner of the present invention and comparative toner. Corona voltage was adjusted to 10 KV and the gap between a photosensitive drum and a magnetic roll was adjusted to 0.5 mm. Atmosphere was 50% RH and 25° C. in one test and 85% RH and 30° C. in another.

Results of the copy test, employing the toner of the present invention, was a very beautiful image on plain paper in both atmospheric conditions. Density of large dark part measured by a densitometer was as high as 1.3. Contrarily, in case that the comparative toner was used, in both atmospheric conditions, the density of large dark part similarly measured was as low as 0.9. Contrast of the image was low in comparison with the case when the toner of the present invention was used.

Next, regarding the toners of the present invention and the comparative toner, repose angle was measured with a repose angle measurement device to give 36° and 35°, respectively. There was no significant difference between the two. Both toners had high flowability. These repose angles did not change after one-month at room temperature.

Next, resistivity of the above two toners was measured with a tera-ohmmeter, manufactured by Kawaguchi Denki Co. Ltd., applying 500 V in voltage to a disk-like toner having 1 cm in radius and 1 mm in thickness pressed under 5 Kg of pressure. Resistivities of the toners of the present invention and the comparative test were both $5\times10^{13}$ Ω·cm.

Next, triboelectricity was measured with the two toners. Namely, an aluminum plate with 0.5 g of the toner of the present invention was placed on a magnetic stirrer. Then, the toner was rotated on the aluminum plate and rubbed with the plate. Potential at the rotation was measured with a surface potentiometer SSVII-40, manufactured by Kawaguchi Denki Co. Ltd., to give 210 V. The potential was very high. That of the comparative toner similarly measured was almost 0 V.

EXAMPLE 2

Resin powder of the same component as Example 1 was made like Example 1. However, contents of polyvinyl butyral resin, caster wax and triiron teroxide were 8 weight %, 32 weight % and 60 weight %, respectively. Like Example 1, flow agent having core of carbon black MA-100 (22μ in particle size and 134 $m^2/g$ in specific surface area by BET method), manufactured by MITSUBISHI CHEMICAL INDUSTRIES LTD., was made. From the above resin powder and the flow agent, dry toner of the present invention in which the flow agent was contained 0.4 weight % based on the total weight was obtained. On the other hand, the same toner as Example 1 was prepared as the comparative toner. Through the same tests and measurements as Example 1, quite the same results as Example 1 were obtained.

EXAMPLE 3

Carbon black used in Example 2 was covered with polypropylene "San Wax" 161-P, manufactured by Sanyo Kasei Co. Ltd. The resin powder was same as in Example 1. By using these resin powder and flow agent, dry toner of the present invention in which flow agent was contained 0.4 weight % based on the total weight behaved similarly as in Example 1.

We claim:

1. A one-component type dry toner, comprising a resin powder having a particle size of between 5 and 50 microns, and from 0.01 weight % to 20 weight % of a flow agent powder having a particle size of no greater than one micron and comprising a core covered with a film no greater than 1,000 anstroms thick of a non-hydrophilic synthetic resin selected from the group consisting of epoxy resin, polyester resin, polystyrene resin, polyvinyl chloride resin, polyethylene resin, polypropylene resin, acrylic resin, xylene resin and silicone resin, the core being consisted of one member selected from the group consisting of carbon black, silica, alumina, magnesia, titania, calcia, zirconia, molybdenum disulfide, tungsten disulfide, boron nitride, silicon nitride, aluminum nitride, metallic soap, higher fatty acid, fatty acid amide, higher alcohol, higher alcohol ester, iron, copper, tin, nickel, cobalt, zinc, silver, iron alloy, copper alloy, tin alloy, nickel alloy, cobalt alloy, zinc alloy, and silver alloy.

2. A dry toner as claimed in claim 1, wherein the resin powder comprises natural resins, modified natural resins, synthetic resins, natural rubbers or synthetic rubbers.

3. A dry toner as claimed in claim 2, wherein the natural resins are balsam, rosin, shellac or copal.

4. The dry toner as claimed in claim 2, wherein the modified natural resins are balsam, rosin, shellac or copal, modified by synthetic resin.

5. A dry toner as claimed in claim 2, wherein the synthetic resins forming the resin powder are vinyl resin, acrylic resin, polyolefin resin, polyamide resin, polyester resin, alkyd resin, phenol-formaldehyde resin, keton resin, coumarone-indene resin, amino resin or epoxy resin.

6. A dry toner as claimed in claim 2, wherein the synthetic rubbers are chlorinated rubber, cyclized rubber, isobutylene rubber, ethylene-propylene rubber, ethylene-propylene-diene rubber butyl rubber, styrene-butadiene rubber or acrylonitril-butadiene rubber.

7. A dry toner as claimed in claim 1, wherein the resin powder contains material having a low melting point.

8. A dry toner as claimed in claim 7, wherein the material having a low melting point is aliphatic wax, metallic salt of acid or low molecular-weight synthetic resin.

9. A dry toner as claimed in claim 1, wherein the resin powder contains magnetic powder.

10. A dry toner as claimed in claim 9, wherein the magnetic powder consists of manganese, iron, cobalt, nickel, chromium, chromium dioxide, iron sesquioxide, triiron teroxide, ferrites, manganese-copper alloy or manganese-tin alloy.

11. A dry toner as claimed in claim 1, wherein the resin powder contains coloring agent.

12. A dry toner as claimed in claim 1, wherein the thickness of the film of non-hydrophilic synthetic resin is no greater than 200 Å.

13. A dry toner as claimed in claim 1, wherein the particle size of the flow agent powder is no greater than 0.5μ.

14. A dry toner as claimed in claim 1, wherein the presence of the flow agent is no greater than 5 weight %.

15. A dry toner as claimed in claim 1, wherein the flow agent contains charge control agent.

16. A dry toner as claimed in claim 1, wherein the average diameter of the resin powder is from 8 to 15 microns.

17. A dry toner as claimed in claim 1, wherein the flow agent has a density greater than 1.5 and floats on water in the aggregated state.

18. A dry toner as claimed in claim 17, wherein the flow agent has a density greater than 2.0 and floats on water in the aggregated state.

* * * * *